US010010199B2

(12) United States Patent
Malcolm et al.

(10) Patent No.: US 10,010,199 B2
(45) Date of Patent: Jul. 3, 2018

(54) DISH ASSEMBLY FOR DISPLAYING AN IMAGE

(71) Applicants: Carter T. Malcolm, Ann Arbor, MI (US); Jacqueline K. Malcolm, Ann Arbor, MI (US)

(72) Inventors: Carter T. Malcolm, Ann Arbor, MI (US); Jacqueline K. Malcolm, Ann Arbor, MI (US)

( * ) Notice: Subject to any disclaimer, the term of this patent is extended or adjusted under 35 U.S.C. 154(b) by 64 days.

(21) Appl. No.: 15/147,431

(22) Filed: May 5, 2016

(65) Prior Publication Data

US 2016/0242581 A1 Aug. 25, 2016

Related U.S. Application Data

(63) Continuation-in-part of application No. 13/941,074, filed on Jul. 12, 2013, now Pat. No. 9,364,105.

(51) Int. Cl.

| | |
|---|---|
| ***A47G 19/00*** | (2006.01) |
| ***A47G 19/02*** | (2006.01) |
| ***B65D 25/28*** | (2006.01) |
| ***B65D 25/04*** | (2006.01) |
| ***B65D 25/24*** | (2006.01) |

(52) U.S. Cl.

CPC ..... *A47G 19/025* (2013.01); *B65D 25/04* (2013.01); *B65D 25/24* (2013.01); *B65D 25/28* (2013.01)

(58) Field of Classification Search

CPC .. A47G 19/025; A47G 19/02; A47G 19/2227; A47G 19/08; G09F 1/12; G09F 23/08

USPC ..... 220/574; 40/700

See application file for complete search history.

(56) References Cited

U.S. PATENT DOCUMENTS

| | | | | |
|---|---|---|---|---|
| 2,861,367 | A * | 11/1958 | Chanslor | A47G 19/025 40/324 |
| 3,515,262 | A * | 6/1970 | Ornstein | B65D 11/16 206/217 |
| 5,640,790 | A * | 6/1997 | Johns | G09F 3/08 40/324 |
| 6,296,488 | B1 * | 10/2001 | Brenkus | A47G 19/025 206/459.5 |
| 9,259,109 | B2 * | 2/2016 | Samenuk | A47G 19/025 |
| 9,271,586 | B2 * | 3/2016 | Ryan | A47G 1/06 |
| 2006/0248769 | A1 * | 11/2006 | Rose | A47G 1/065 40/734 |
| 2007/0151977 | A1 * | 7/2007 | Casale | A47G 19/025 220/574 |

* cited by examiner

*Primary Examiner* — Shawn M Braden
(74) *Attorney, Agent, or Firm* — Brinks Gilson & Lione

(57) ABSTRACT

A vessel includes a first side and a second side, wherein at least a portion of the vessel is at least partially transparent. A plurality of brackets is coupled to the second side of the vessel. The plurality of brackets is configured to detachably retain a support base to the vessel. The support base is configured to retain an image between the support base and the second side of the vessel for allowing the image to be viewed though the portion of the vessel that is at least partially transparent. Each of the plurality of brackets has a lip portion made of a flexible material and configured to removeably retain the support base.

21 Claims, 8 Drawing Sheets

DISH ASSEMBLY FOR DISPLAYING AN IMAGE

CROSS REFERENCE TO RELATED APPLICATIONS

This application is a continuation-in-part to U.S. patent application Ser. No. 13/941,074 filed on Jul. 12, 2013, which is hereby incorporated by reference in its entirety.

BACKGROUND

1. Field of the Invention

The invention relates to vessels for presenting food and more specifically to vessels for presenting food to children.

2. Description of the Known Art

Vessels for serving food are known in the art. These vessels can include plates, bowls, glasses, cups, mugs, or any other device as designed to temporarily carry food and provide it for a person to ingest. Additionally, there have been a number of vessels that are designed specifically for temporarily holding food that is to be served to children. Typically, these vessels are similar to those described above but may be made generally smaller in size to accommodate the smaller stature of children.

Additionally, these vessels that are specifically designed for children may have a variety of different designs or images fixed on the serving vessels to provide entertainment for children. However, as these designs and images are static in nature, the effect of the designs meant to entertain children become less and less over time, as children become more familiar with these designs.

SUMMARY

A vessel assembly for displaying an image includes a vessel having a first side and a second side, where at least a portion of the vessel is at least partially transparent. The vessel may be flat or may be concave in shape and may be a plate, dish, bowl, cup, mug, or the like.

A plurality of brackets is coupled to the second side of the vessel. The plurality of brackets is configured to detachably retain a support base to the vessel. Each of the plurality of brackets has a lip portion made of a flexible material and configured to removeably retain the support base. First and second support legs may flank each of the lip portions of the brackets, such that the lip portion is located adjacent and between first and second support legs The support base may further include a first side and a second side, wherein the first side contains a cavity for retaining the image. The cavity may also include a cutout portion for allowing the image to be easily removed from the cavity. In like manner, the second side of the support base may also include a cavity for retaining an image as well as a cutout for allowing the image to be easily removed from the second cavity.

The plurality of brackets may include a first bracket, a second bracket, and a third bracket. The first bracket, second bracket, and third bracket may be substantially equal distance from each other on the second side of the vessel. Further, an edging may be located on the second side of the vessel extending between the first bracket and the second bracket and the third bracket. However, the edging may only partially extend from the third bracket to the first bracket to define an opening between the edging and the first bracket.

The base plate may further include a handle. When retained by the brackets, the handle may extend through the opening tween the edging and the first bracket. The handle may be adjacent to the first bracket when the base plate is retained by the plurality of brackets.

Further objects, features and advantages of this invention will become readily apparent to persons skilled in the art after a review of the following description, with reference to the drawings and claims that are appended to and form a part of this specification.

BRIEF DESCRIPTION OF THE DRAWINGS

FIGS. 8 and 9 illustrate another example of the vessel assembly, wherein FIG. 8 shows the vessel assembly without dividing walls, while FIG. 9 shows the vessel assembly with dividing walls;

DETAILED DESCRIPTION

Figure 1:
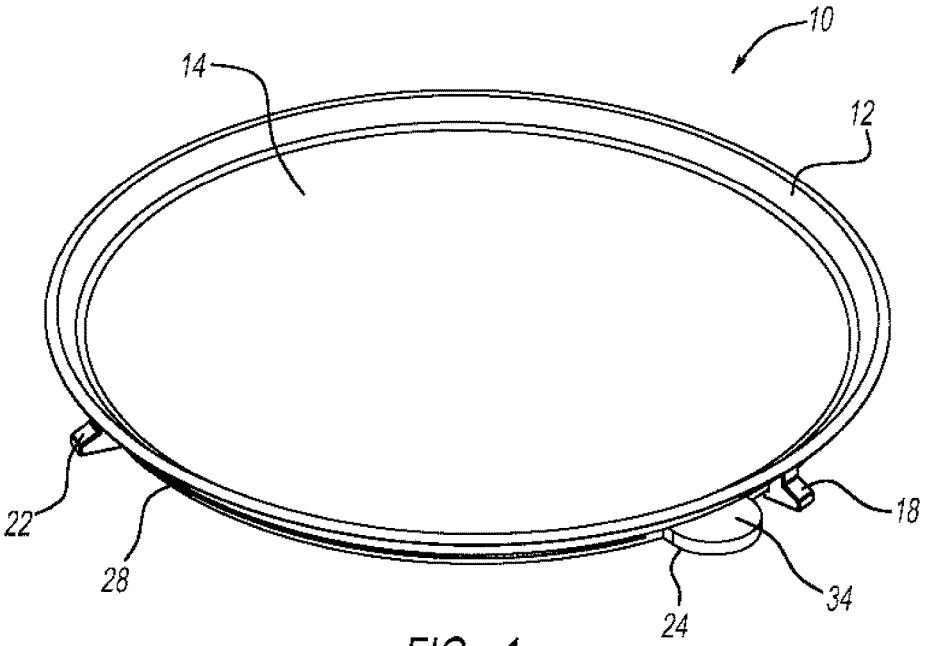
FIG. 1 illustrates a vessel assembly.

Referring to FIGS. 1-4, a vessel assembly 10 is shown. As its primary components, the vessel assembly includes a vessel 12 having a top side 14 and a bottom side 16. At least a portion of the vessel 12 may be partially transparent. In this embodiment, the entire vessel 12 is transparent; however, as stated before, only a portion of the vessel 12 may be transparent or partially transparent. The vessel 12 may be any one of a number of different items configured to serve food to a person. For example, the vessel 12 may be a plate (as shown), a bowl, a dish, a glass, cup, mug, or the like.

The vessel 12 may be made of any one of a number of different materials such as metal, wood, plastic, or glass. Generally, the transparent portions of the vessel 12 would be made of a transparent plastic or transparent glass. The vessel 12 may have a substantially circular shape but may take any one of a variety of different shapes such as a rectangle or triangular-type shape or any other suitable shape. Further, the transparent portions of the vessel 12 may be a clear transparency or may be any number of transparent or partially transparent colors.

A plurality of brackets including a first bracket 18, a second bracket 20, and a third bracket 22 are coupled to the second side 16 of the vessel 12. The plurality of brackets may be configured to stabilize the vessel on a flat surface, such as a table. The plurality of brackets is also configured to detachably retain a support base 24 to the vessel assembly 10. The support base 24 is configured to retain an image between the support base 24 and the second side 16 of the vessel 12 for allowing the image to be viewed through a portion of the vessel 12 as at least partially transparent.

The first bracket 18, second bracket 20 and third bracket 22 are generally made of a rigid or semi-rigid material such as a rigid or semi-rigid plastic or thermoplastic material. The first bracket 18, second bracket 20, and third bracket 22 are generally substantially equal distance from each other on the second side 16 of the vessel 12.

Figure 5:
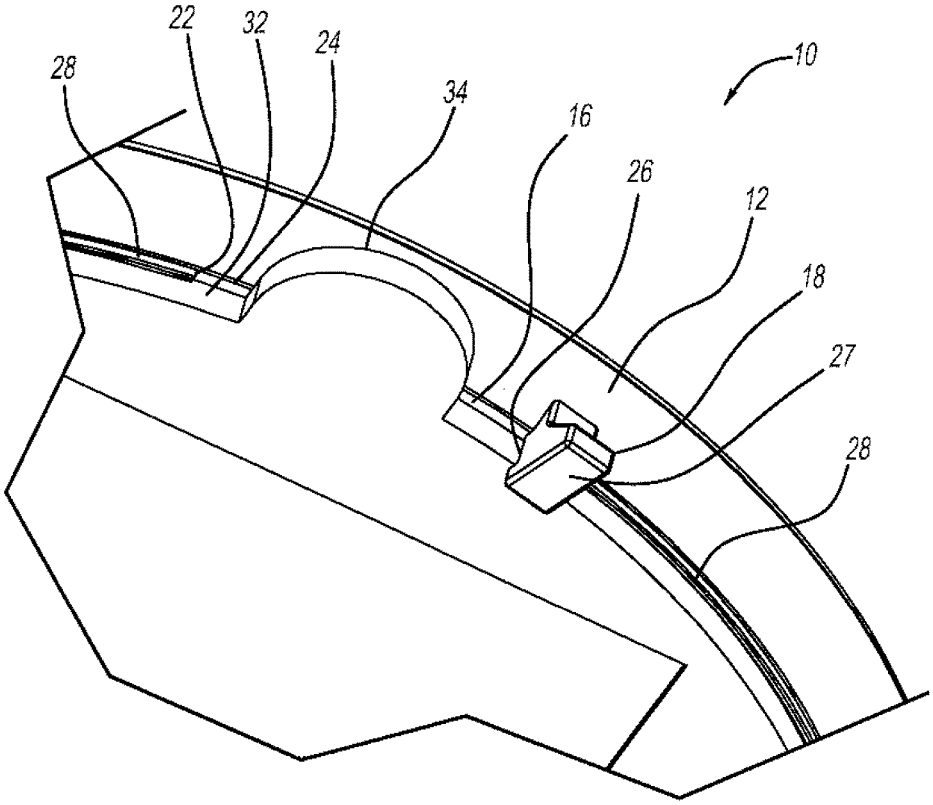
FIG. 5 illustrates a more detailed view of the vessel and bracket of FIG. 4.

Referring to FIG. 5, a more detailed view of the first bracket 18 is shown. It should be understood that any description given to the first bracket is equally applicable to the second bracket 20 and third bracket 22 unless specifically noted. The first bracket 18 may includes a small lip portion 26 which is configured to accommodate the perimeter 28 of the support plate 24. Essentially, the first bracket 18, second bracket 20, and third bracket 22 each have a lip 26 that retains a portion of the perimeter 28 of the support plate 24 towards the second side 16 of the vessel 12. Any images that are located between the support plate 24 and vessel 12 can then be displayed through any transparent portions of the vessel 12.

The brackets the first bracket 18, second bracket 20, and third bracket 22 may each also have a flat portion 27 that may define a surface that is substantially parallel the a surface defined by the first side 14 of the vessel 12. The flat portion 27 may assist with stabilizing the vessel assembly 10 on a flat surface, such as a table.

Figure 2:
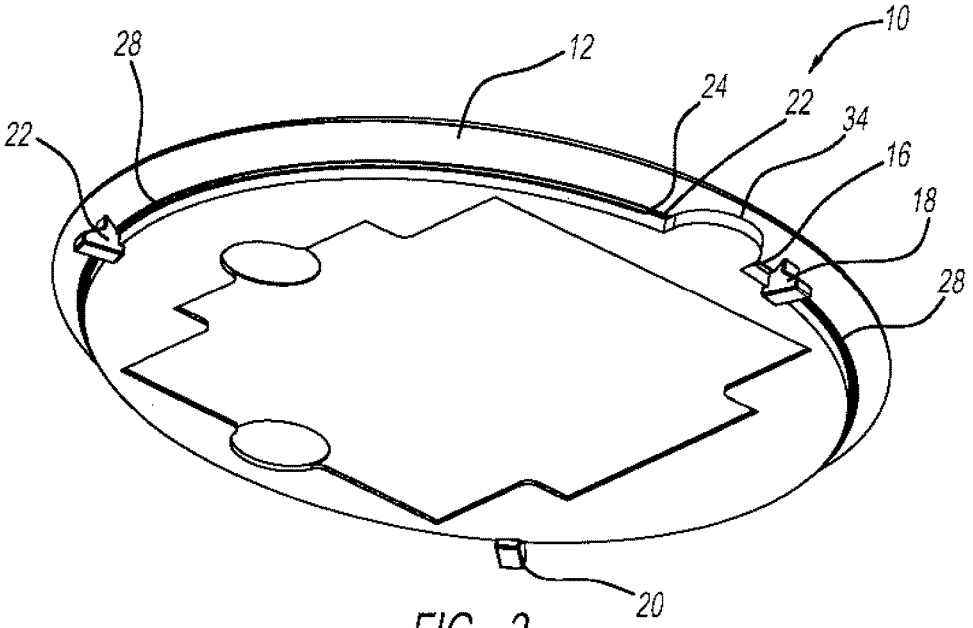
FIG. 2 illustrates a bottom side of the vessel assembly of FIG. 1.
Figure 3:
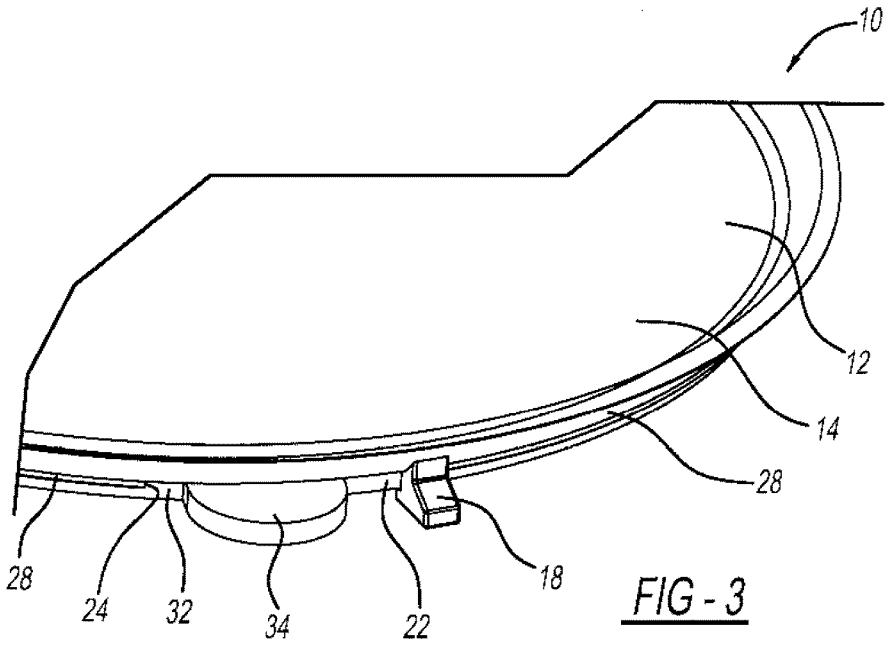
FIG. 3 illustrates a more detailed view of the vessel near a bracket.
Figure 4:
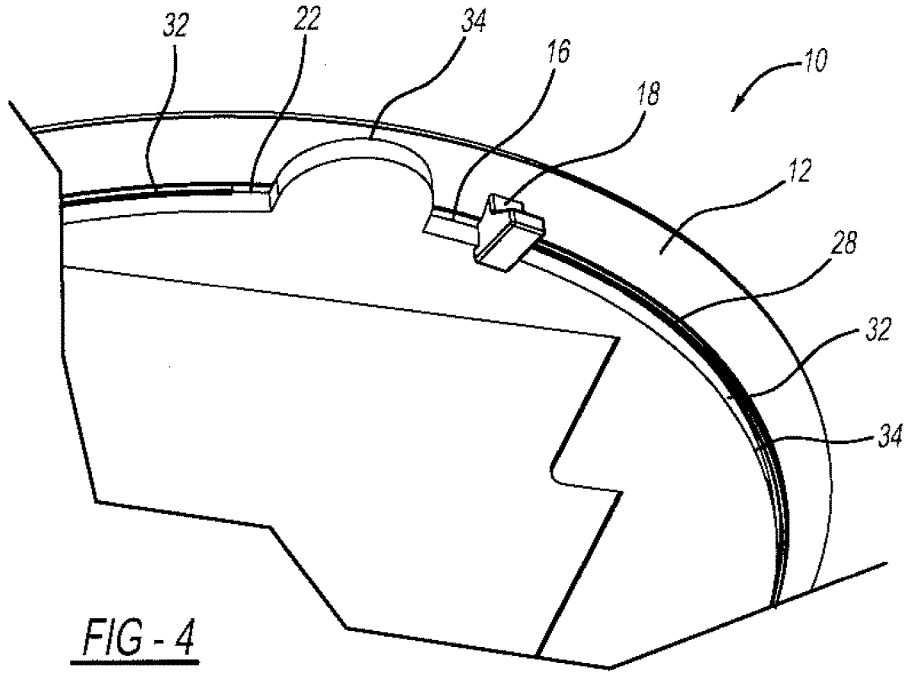
FIG. 4 illustrates a bottom side of the vessel illustrated in FIG. 3.

Referring to FIG. 2, an edging 28 may be located between and extend from the first bracket 18 to the second bracket 20. This edging may continue to extend from the second bracket 20 and third bracket 22. Finally, this edging may extend from the third bracket 22 towards to first bracket 18 but not touch the first bracket 18 thereby creating the opening 32.

The opening 32 can allow a handle 34 of the base plate 24 to protrude therefrom through the opening 32. This also has the additional advantage that it allows the user to easily remove the base plate 24 from the second side 16 of the vessel 12. Essentially, a user can use a combination of their finger and thumb, wherein either the finger or thumb is located on the handle 34 or the bracket 20 to allow the base plate 24 to be easily popped out of the retaining brackets 18, 20, and 22.

Figure 6:
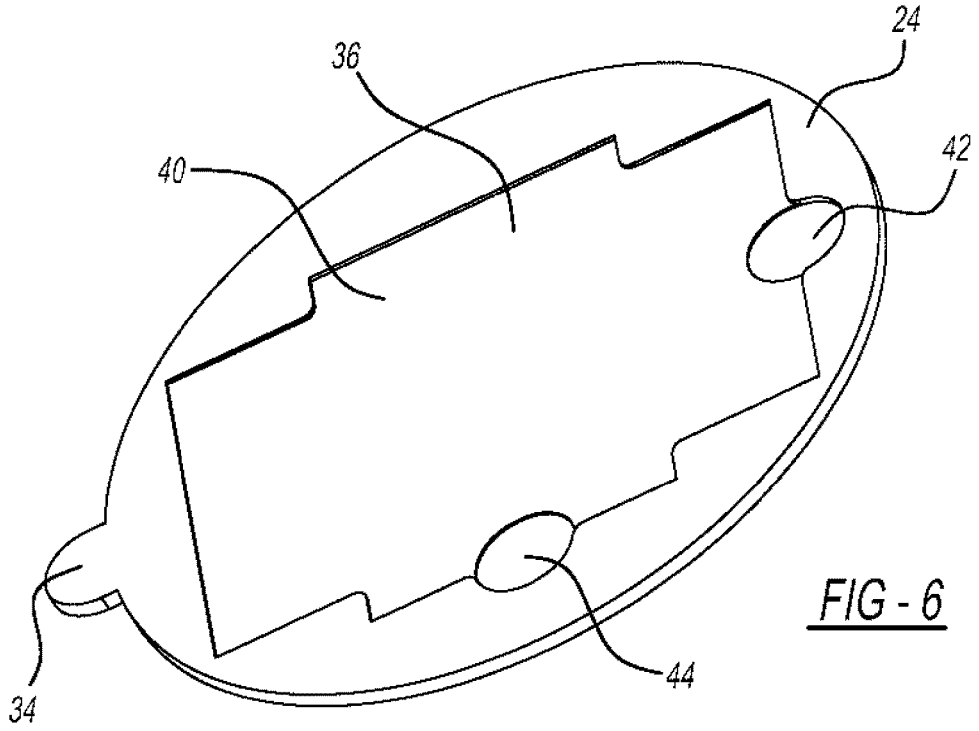
FIG. 6 Illustrates a first side of a support base.
Figure 7:
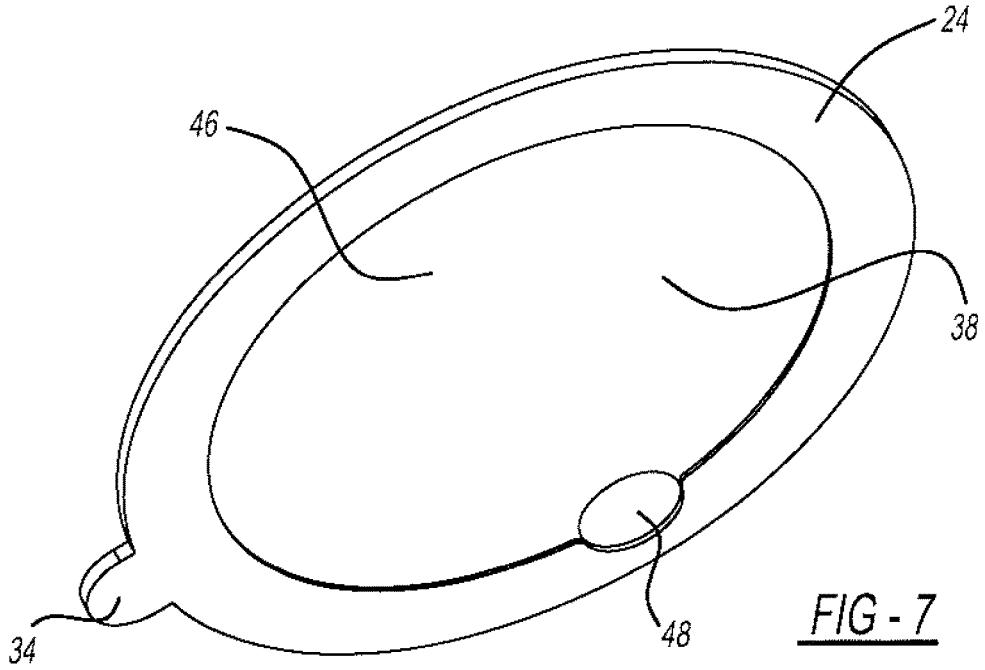
FIG. 7 illustrates a second side of the support base of FIG. 6.
Figure 8:
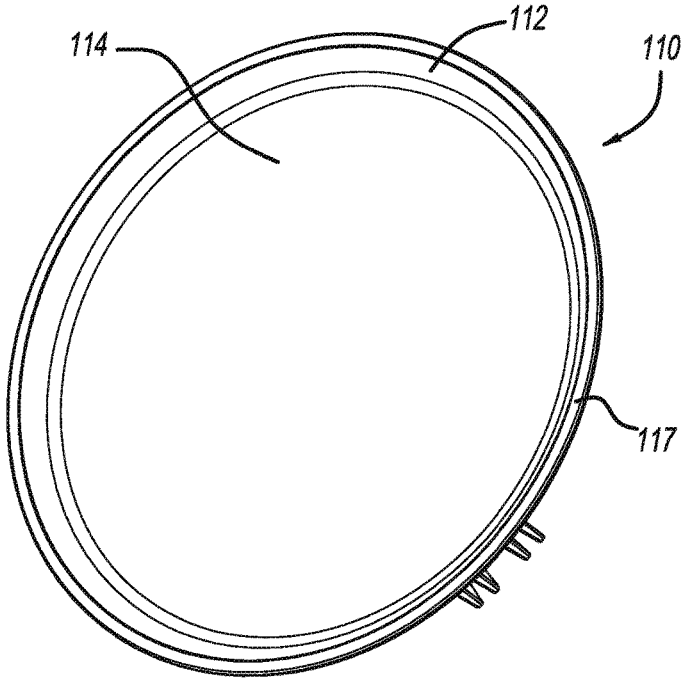

Referring to FIGS. 6 and 7, a first side 36 and a second side 38 of the base plate 24 is shown. The first side 36 may include a cavity 40 for retaining an image, such as a photograph. The cavity 40 may be rectangular in nature or may be two rectangles laid on top of each other to allow different sizes of photographs to be utilized. Additionally, the first side 36 may include a first cutout 42 and even a second cutout 44 to allow easy removal of any image located within the cavity 38.

Referring to FIG. 7, the second side 38 of the base plate 24 may include a circular cavity 46. The circular cavity 46 also includes a cutout 48 to allow easy removal of a circular shape image from the cavity 46.

It should also be understood that an image may be permanently fixed to either the first side 36 or the second side 38 of the support base 24. For example, an image may be permanently printed on either the first side 36 or the second side 38 of the support base 24. Further, the cavity 40 or 46 may take any one of a number of different shapes to accommodate an image, such as a photograph.

Referring to FIGS. 8-11, another example of the vessel assembly 110 is shown. Like before, as its primary components, the vessel assembly 110 includes a vessel 112 having a top side 114 and a bottom side 116. At least a portion of the vessel 112 may be partially transparent. In this embodiment, the entire vessel 112 is transparent; however, as stated before, only a portion of the vessel 112 may be transparent or partially transparent. The vessel 112 may be any one of a number of different items to configure to serve food to a person. For example, the vessel 112 may be at play, as shown, a bowl, a dish, a glass, cup, mug, or the like.

The vessel 112 may be made of any one of a number of different materials such as metal, wood, plastic, or glass. Generally, the transparent portions of the vessel 12 would be made of a transparent plastic or transparent glass. The vessel 112 may have a substantially circular shape that may take any one of a number of different shapes, such as a rectangle or triangular type shape, or any other suitable shape. Further, the transparent portions of the vessel 112 may be made of a clear transparency or may be any number of transparent or partially transparent colors.

Figure 9:
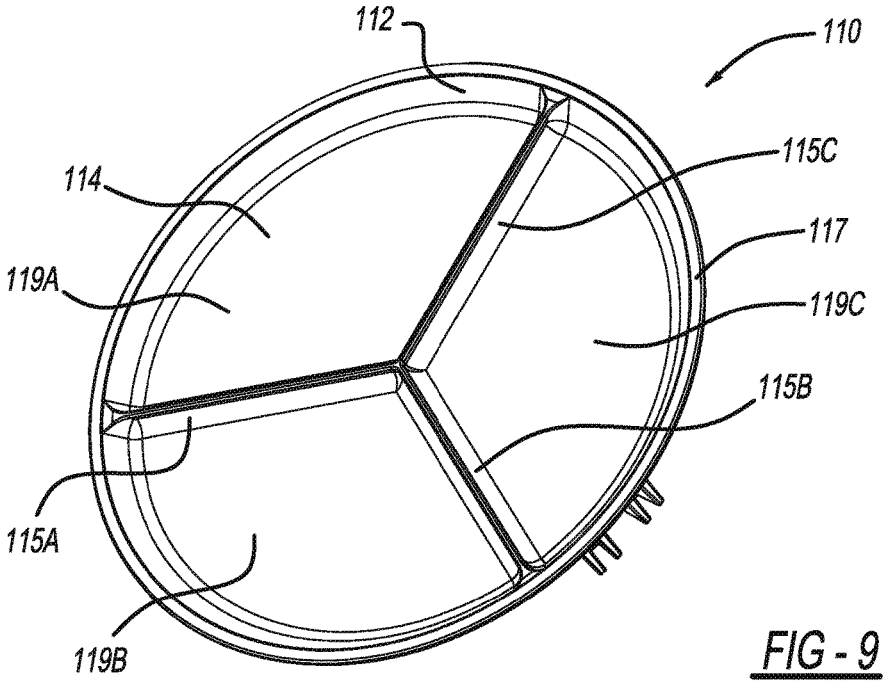

With particular attention to FIG. 9, the top side 114 of the vessel 110 may include one or more dividing walls 115A-115C. These dividing walls 115A-115C may create, along with a perimeter 117 of the vessel assembly 110, one or more cavities 119A-119C. The cavities 119A-119C can be used to separate different items, such as different types of food, in the vessel assembly 110. Further, it should be understood that any one of a number of different dividing walls 115A-115C can be utilized to create any one of a number of different cavity configurations 119A-119C. In this example, there are three cavities in 119A-119C but it should be understood that any one of a number of different cavities having different sizes or shapes can be created.

Figure 10:
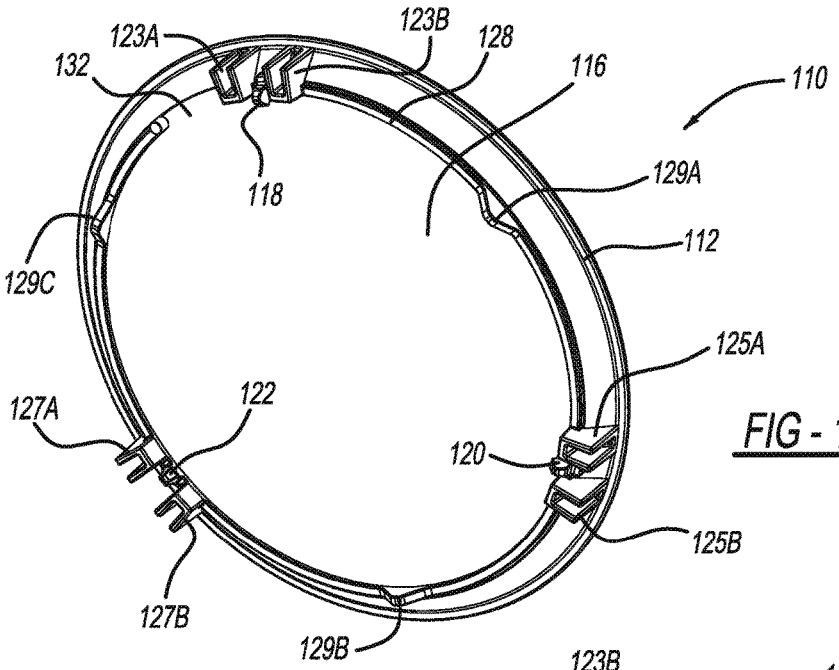
FIGS. 10 and 11 illustrate a bottom side of the vessel assembly illustrated in FIG. 8 or 9.
Figure 11:
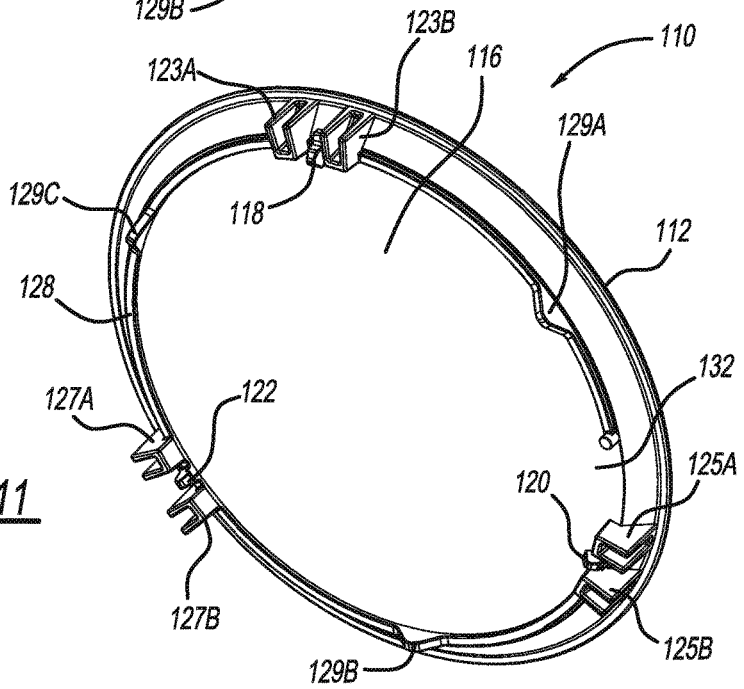

Referring to FIGS. 10 and 11, the vessel assembly 110 may include a first bracket 118, a second bracket 120, and a third bracket 122, which are coupled, at least in part, to the second side 116 of the vessel 112. The plurality of brackets are configured to detachably retain the support base 24 illustrated in FIGS. 6 and 7 or the support base 124, illustrated in FIGS. 14 and 15 and described later in this description. Generally, the plurality of brackets 118, 120, and 122 are made of a flexible material allowing the brackets to bend slightly to accept the support base 24 or 124. The first bracket 118, second bracket 120, and third bracket 122 are generally substantially equally distance from each other on the second side 116 of the vessel 112.

The term "flexible" in the specification and the claims should be understood to mean any amount or form of flexibility. For example, the flexibility of the brackets 118, 120, and/or 122 may be such that the brackets 118, 120, and/or 122 are bendable, slightly bendable, or bendable only upon the application of force. In any case, the flexibility of the brackets 118, 120, and/or 122 can vary significantly, as long as the brackets 118, 120, and/or 122 allow for some movement to allow the insertion or removal of the of the support base 24 or 124 from the vessel assembly 110.

Additionally, located near the brackets 118, 120, and 122 is at least one support leg. Here, the bracket 118 is between and adjacent to support legs 123A and 123B. The bracket 120 is located between an adjacent to support legs 125A and 125B. Finally, the bracket 122 is located between an adjacent to support legs 127A and 127B. Each of the support legs 123A, 123B, 125A, 125B, 127A, and 127B, are substantially similar to each other and generally provide support and stabilization for the vessel assembly 110, when a second side 116 of the vessel assembly 110 is placed on a flat surface, such as a table.

In addition, an edging 128 may generally follow the circumference or perimeter of the bottom side of 116 of the vessel assembly 110. The edging 128 in FIG. 10 extends between the first bracket 118 to the second bracket 120, then to the third bracket 122 and then part way to the first bracket 118, therefore defining an opening 132. Of course, it should be understood that the edging 128 may take any one of a number of different forms and may extend from any one of a number of different brackets. For example, in the example shown in FIG. 11, the opening 132 is located between the first bracket and the second bracket 120, and not between the third bracket 122 and the first bracket 118, as shown in FIG. 10.

Furthermore, the vessel assembly 110 may have stabilization legs 129A, 129B, and 129C. In this example, the stabilization legs 129A-129C extend from the edging 128. However, it should be understood that the stabilization legs 129A-129C may extend from any portion of the bottom side 116 of the vessel assembly 110. The stabilization legs 129A-129C serve to provide additional stability to the vessel assembly 110, when the vessel assembly 110 is placed on a flat surface, such as a table. The stabilization legs 129A-129C may take any one of a number of different suitable shapes, such as a triangular shape as shown. There can be any number of stabilization legs, and it is contemplated that they may take different configurations and sizes. For instance, there may only be two stabilization legs that each extend around a larger portion of the circumference.

Figure 12:
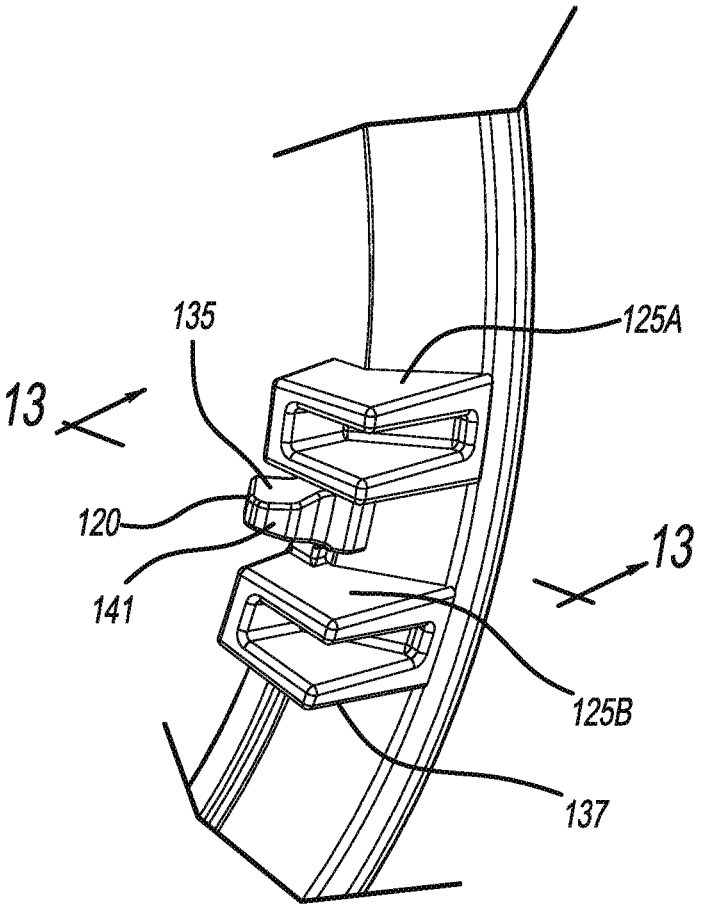
FIG. 12 illustrates a more detailed view of the bracket of the vessel assembly illustrating FIGS. 8 and 9.
Figure 13:
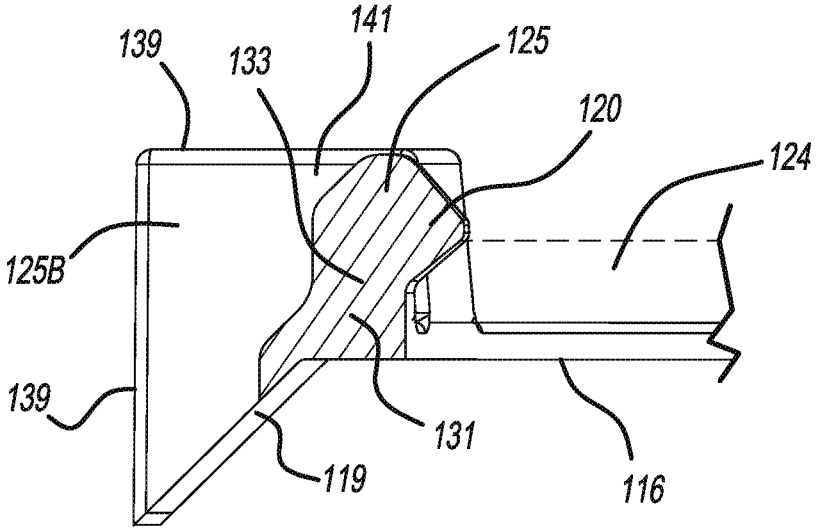
FIG. 13 illustrates a cross-sectional view of the bracket of FIG. 10 generally taken along lines 13-13 of FIG. 12.

Referring to FIGS. 12 and 13, a more detailed view of the bracket 120 and support legs 125A-125B is shown. It should be understood that the illustrations of FIGS. 12 and 13 and related description, are applicable to the other brackets and other support legs mentioned in this specification. The bracket 120 has a base portion 131 that may be attached to the bottom side 116 of the vessel assembly 110. In addition, the base 131 of the bracket 120 may also be attached to portions of the perimeter 119 of the vessel assembly 110 as well. The bracket assembly 120 also has a neck portion 133 and a lip portion 135. The neck portion 133 allows the lip portion 135 of the bracket assembly 120 to move slightly so as to allow retention or release of the support base 124. In order to insert or remove a support base 124, one simply needs to bend the bracket assembly 120 by pushing slightly on the lip portion 135 so as to allow the neck portion 133 to bend slightly allowing insertion or removal of the support base 124.

The support legs 125A and 125B generally have a flat portion 137 that defines a surface that is substantially parallel to the bottom side 116 of the vessel assembly 110. A second side 139 of the support leg 125B may stand substantially perpendicular to the bottom side 137 towards the perimeter 119. Generally, the support legs 125A and 125B define a cavity 141 located between the support legs 125A and 125B. The lip portion 135 of the bracket 120 is located within the cavity 141. By so doing, the lip portion 135 will not come into contact with a support surface, such as a table, when the vessel assembly 110 is placed on a table. This in turn has the advantage of preventing the lip portion 135 from being actuated by the table, preventing the unintentional removal of the support base 124.

Figure 14:
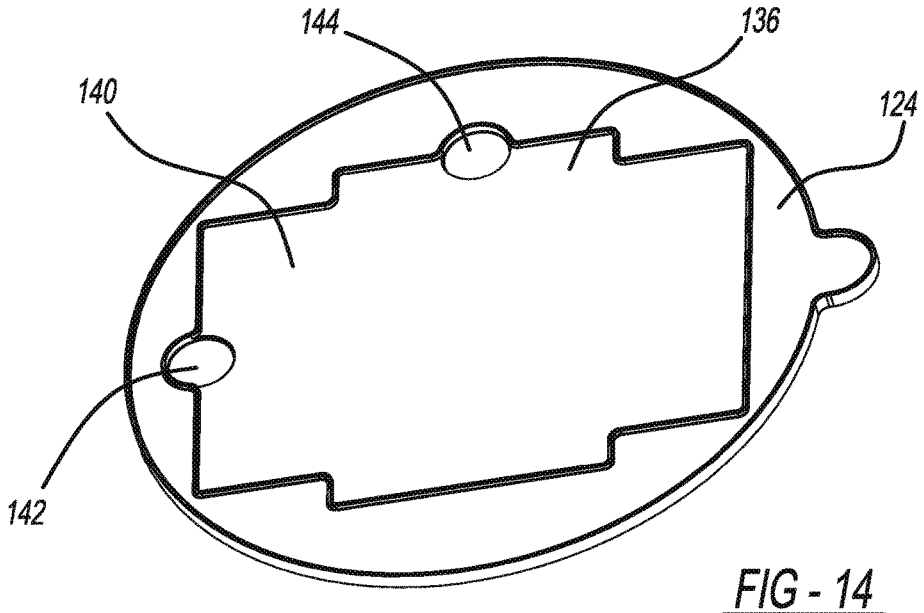
FIG. 14 illustrates a first side of another example of a support base.
Figure 15:
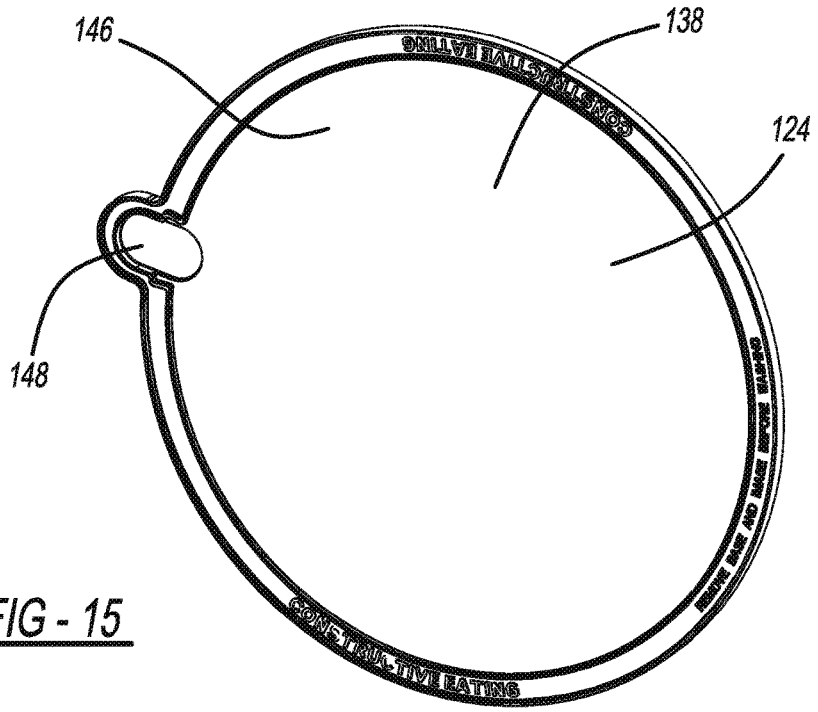
FIG. 15 illustrates a second side of another example of the support base.

Referring to FIGS. 14 and 15, another example of the support base 124 is shown. The support base has a first side 136 and a second side 138. The first side 136 may include a cavity 140 for retaining an image, such as a photograph. The cavity 140 may be rectangular in nature or may be two rectangles lying on top of each other to allow different sizes of photographs to be utilized. Additionally, the first side 136 may include a first cut out 142 and a second cut out 144 to allow easy removal of any image located within the cavity 138.

Referring to FIG. 15, the second side 138 of the base plate 124 may include a circular cavity 146. Here, the circular cavity 146 also includes a cut out 148 to allow easy removal of a circular shaped image from the cavity 146. Here, the cavity 148 extends within the cavity 138 as well as extending outside the cavity 138. By so doing, the cavity 148 functions not only to allow easy removal of any image located within the cavity 138, but also allows one to more easily grip the support base 124.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

The invention claimed is:

1. A vessel assembly for displaying an image comprising:

a vessel having a first side and a second side, wherein at least a portion of the vessel is at least partially transparent;

a plurality of brackets coupled to the second side of the vessel, the plurality of brackets being configured to detachably retain a support base to the vessel, whereby the support base retains an image between the support base and the second side of the vessel for allowing the image to be viewed though the portion of the vessel that is at least partially transparent;

each of the plurality of brackets have a lip portion, a neck portion, and a base portion, the lip portion configured to removeably retain the support base, the neck portion is between and connects the lip portion and the base portion, the base portion is connected to the second side of the vessel; and wherein the neck portion is configured to allow for the movement of the lip portion with respect to the base portion when the lip portion is actuated.

2. The vessel assembly of claim 1, wherein the lip portion being made of a flexible material and configured to removeably retain the support base.

3. The vessel assembly of claim 1, wherein the lip portion of the plurality of brackets is configured to engage a perimeter of the support base.

4. The vessel assembly of claim 1, wherein each bracket further comprises at least one support leg adjacent to the lip portion.

5. The vessel assembly of claim 4, further comprising a first and second support leg, wherein the lip portion is located adjacent and between the first and second support legs.

6. The vessel assembly of claim 1, further comprising the support base.

7. The vessel assembly of claim 6, wherein the support base further comprises a first side and a second side, wherein the first side contains a cavity for retaining the image.

8. The vessel assembly of claim 7, wherein the cavity further includes a cutout portion for allowing the image to be easily removed from the cavity.

9. The vessel assembly of claim 7, wherein the second side of the support base contains a second cavity for retaining the image.

10. The vessel assembly of claim 7, wherein the second cavity further includes a cutout portion for allowing the image to be easily removed from the second cavity.

11. The vessel assembly of claim 1, wherein the vessel is a plate or a bowl.

12. The vessel assembly of claim 1, wherein the plurality of brackets comprise a first bracket, a second bracket and a third bracket, wherein the first bracket, the second bracket and the third bracket are substantially equal distance from each other on the second side of the vessel.

13. A vessel assembly for displaying an image comprising:

a vessel having a first side and a second side, wherein at least a portion of the vessel is at least partially transparent;

a plurality of brackets coupled to the second side of the vessel, the plurality of brackets being configured to detachably retain a support base to the vessel, whereby the support base retains an image between the support base and the second side of the vessel for allowing the image to be viewed though the portion of the vessel that is at least partially transparent;

each of the plurality of brackets have a lip portion, the lip portion configured to removeably retain the support base;

wherein the plurality of brackets comprise a first bracket, a second bracket and a third bracket, wherein the first bracket, the second bracket and the third bracket are substantially equal distance from each other on the second side of the vessel; and the edging extending between the first bracket and the second bracket and between the second bracket and the third bracket.

14. The vessel assembly of claim 13, wherein the edging defines a substantially circular shape.

15. The vessel assembly of claim 13, wherein the edging extends partially from the third bracket to first bracket to define an opening between the edging and the first bracket.

16. The vessel assembly of claim 15, wherein the base plate further comprises a handle, wherein the handle extends though the opening when the base plate is retained by the plurality of brackets.

17. The vessel assembly of claim 16, wherein the handle of the base plate is adjacent to the first bracket when the base plate is retained by the plurality of brackets, wherein the handle extends though the opening when the base plate is retained by the plurality of brackets.

18. The vessel assembly of claim 13, further comprising at least one stabilizing leg extending from the edging.

19. The vessel assembly of claim 1, wherein the first side has at least one dividing wall, the dividing wall defining at least one cavity.

20. A vessel assembly for displaying an image comprising:

a vessel having a first side and a second side, wherein at least a portion of the vessel is at least partially transparent;

a plurality of brackets coupled to the second side of the vessel, the plurality of brackets being configured to detachably retain a support base to the vessel, whereby the support base retains an image between the support base and the second side of the vessel for allowing the image to be viewed though the portion of the vessel that is at least partially transparent; and at least one of the plurality of brackets have a lip portion, a neck portion, and a base portion, the lip portion configured to removeably retain the support base, the neck portion is between and connects the lip portion and the base portion, the base portion is connected to the second side of the vessel; and wherein the neck portion is configured to allow for the movement of the lip portion with respect to the base portion when the lip portion is actuated.

21. The vessel assembly of claim 20, wherein at least one of the plurality of brackets have a lip portion, the lip portion being made of a flexible material and configured to removeably retain the support base.

* * * * *